US005855988A

United States Patent [19]

Matsuo

[11] Patent Number: 5,855,988

[45] Date of Patent: Jan. 5, 1999

[54] ELECTROMAGNETIC WAVE ABSORBING SHIELDING MATERIAL

[75] Inventor: Seiichi Matsuo, Osaka, Japan

[73] Assignee: Nippon Paint Co., Ltd., Osaka-fu, Japan

[21] Appl. No.: 753,595

[22] Filed: Nov. 27, 1996

[30] Foreign Application Priority Data

Nov. 27, 1995 [JP] Japan ..... 7-307246
Nov. 27, 1995 [JP] Japan ..... 7-307248

[51] Int. Cl.[6] ..... H01Q 17/00

[52] U.S. Cl. ..... 428/195; 428/929; 428/930; 428/411.1; 428/901; 428/689; 428/457; 342/1; 342/2; 342/3

[58] Field of Search ..... 428/195, 929, 428/930, 411.1, 901, 689, 457

[56] References Cited

U.S. PATENT DOCUMENTS 5,214,432 5/1993 Kasevich et al. ..... 342/3
5,223,849 6/1993 Kasevich et al. ..... 343/895
5,325,094 6/1994 Broderick et al. ..... 342/1

FOREIGN PATENT DOCUMENTS

WO 93/23893 of 1993 WIPO .
WO 93/23893 11/1993 WIPO .

*Primary Examiner*—Richard Weisberger
*Attorney, Agent, or Firm*—Wenderoth, Lind & Ponack, L.L.P.

[57] ABSTRACT

An electromagnetic wave absorbing shielding material which is thin and lightweight and shows high electromagnetic wave absorbing capacity in a wide frequency region. The material comprises:

(1) a one-dimensional conductive segment pattern which is a conductive segment pattern formed from a conductive material, wherein the conductive segment pattern has a length of more than ½ of the wavelength of the subjective electromagnetic wave, and the segment pattern has no electrical connection therebetween, (2) an electromagnetic wave shielding layer, and (3) an insulating intermediate material having a thickness of 0.1–10.0 mm, located between the one-dimensional conductive segment pattern (1) and the electromagnetic wave shielding layer (2).

10 Claims, 13 Drawing Sheets

DESIGN DIAMETER=4cm
LINE WIDTH=30μ

LINE LENGTH=1mm

LATTIA

DESIGN DIAMETER=5cm
LINE WIDTH=30μ

LINE WIDTH=30μ
LINE SPACE=170μ

DESIGN DIAMETER=4cm
LINE WIDTH=30μ

LINE WIDTH=30μ

LINE WIDTH=30μ

ELECTROMAGNETIC WAVE ABSORBING SHIELDING MATERIAL

FIELD OF THE INVENTION

The present invention relates to an electromagnetic wave absorbing shielding material which can be used in a space in which absorption of unnecessary electromagnetic waves is required, such as the interior of electronic apparatus and offices, and can be used on the outer wall of buildings for TV ghost prevention, being a thin film and light in weight, and having high absorbing capacity in a wide frequency range.

BACKGROUND OF THE INVENTION

In recent years, it is necessary to shut electric waves in and out of buildings by surrounding with shielding material for protecting office information and for preventing mixing of communication lines, due to the progress of the communication systems such as portable telephone, wireless LAN, and the like.

However, the electromagnetic wave shielding materials which have been used only reflect the electromagnetic wave 100%, and the electromagnetic waves stored in a closed room have danger of inducing disturbance of communication lines and erroneous operation of electronic apparatuses. Especially, due to the progress of the semiconductor techniques in future, microelectronics and control systems made by applying them tend to show higher density, so that the disposition of the reflected electromagnetic waves in tightly closed spaces is a subject still to be settled.

As a means of preventing these obstacles caused by the reflection of electromagnetic wave, there is known a wave absorbing material having a coating layer dispersing ferrite in an organic polymer. However, in order for such electromagnetic wave absorbing material to obtain practically effective absorbing capacity, there is necessitated a thick film of more than 2 mm, and the medium becomes a heavy product of more than 8 $Kg/m^2$. Accordingly, when such material is applied to a building, the strength of the whole building has to be increased to support such product, with requirement of high cost. It also associates various problems for the work of adhering it onto a wall surface and the like.

To cope with the above, Japanese Patent Laid-open Publication No. 6-140787/1994 proposes that a ferrite and carbon powder dispersed resin layer is sandwiched between an electric wave reflecting layer and an electroconductive pattern. However, it also has limitation in reduction of weight, because of the large specific gravity of ferrite.

In addition, construction of multi-storied buildings gives rise to a problem in occurrence of TV ghost. To solve the problem, there are required low frequency of the subjective electric wave and high absorbing capacity, so that a 6–8 mm ferrite sintered medium is applied to the buildings. Its weight is more than 40 $kg/m^2$, and it is very difficult to make the structure to withstand such a heavy weight. It is more difficult to build higher storied buildings, which requires enormous building cost. Accordingly, the development of electric wave absorbing material having light weight and high absorbing capacity is desired.

SUMMARY OF THE INVENTION

The present invention provides an electromagnetic wave absorbing material of thin film and lightweight having high electromagnetic wave absorbing capacity without using a layer of high magnetic permeability or high dielectric constant containing ferrite and the like. Accordingly, the present invention provides an electromagnetic wave absorbing shielding material comprising:

(1) a one-dimensional conductive segment pattern which is conductive segment pattern formed from a conductive material, the conductive segment pattern having a length of more than ½ of the wavelength of the subjective electromagnetic wave, and said segment pattern having no electrical connection therebetween, (2) an electromagnetic wave shielding layer, and (3) an insulating intermediate material having a thickness of 0.1–10.0 mm, located between the one-dimensional conductive segment pattern (1) and the electromagnetic wave shielding layer (2).

By forming a layer having high magnetic permeability or high dielectric constant on the upper layer of the one-dimensional conductive segment pattern of the electromagnetic wave absorbing shielding material of the present invention, the electromagnetic wave absorbing range is shifted to the low frequency side to make it possible to absorb the electromagnetic waves of broad wavelength range with a short length of the segment of the conductive segment pattern.

The electromagnetic wave shielding layer (2) and the insulating intermediate material (3) can be either opaque or transparent. If both the electromagnetic wave shielding layer (2) and the insulating intermediate material (3) are transparent, that is visible light permeable, the resultant electromagnetic wave absorbing shielding material is also transparent, because the one-dimensional conductive segment pattern (1) inherently has visible light permeability.

DETAILED DESCRIPTION OF THE INVENTION

One-dimensional conductive segment pattern (1) po In the present invention, the one-dimensional conductive segment pattern (1) having electromagnetic wave absorbing capacity is a pattern formed only by the conductive segments from a conductive material, and the segment pattern does not have any electric connection therebetween, namely, there is no electric contact with each other. The term "one-dimensional" is a word to make it clear that the pattern is constituted solely by the conductive segments and there is no electrical connection between the respective segments. Accordingly, the term "two-dimensional" denotes the case where there is electrical connection between the segments, and "zero-dimensional pattern" is the pattern formed of the continuation of dots or short segments. In the conductive segment pattern, each conductive segment pattern has a length of ½ of the wavelength of the electromagnetic wave. Accordingly, the length of each segment differs by the subjective electromagnetic wave. The conductive segment pattern preferably has a thickness of 50 to 5,000 Å.

Examples of the one-dimensional conductive segment pattern are shown in FIG. 1 (*a*)–(*f*). FIG. 1 (*a*)–(*f*) are simple exemplifications and the embodiments are not to be limited to them. Basically, the segments are formed from conductive metal, as described above, and have a length of more than ½ of the electromagnetic wavelength to which these segments are applicable. The segment may be bent or may constitute a circle. Alternatively, some segments of different lengths may gather collectively to form a pattern (FIG. 1 (*a*)–(*c*)). FIG. 1 (*d*) shows a case where the segments constitute a bellow-like shape. FIG. 1 (*e*) shows that each segment constitutes a circle, and some circles having different radii are combined to form a pattern. FIG. 1 (*f*) has a spiral pattern.

What is important in the electromagnetic wave absorbing capacity is that, as stated above, each conductive pattern is one-dimensional, namely, not electrically connected with each other segment. If it had the electrical connection, the pattern would not show electromagnetic wave absorbing capacity but inversely shows only the electromagnetic wave shielding property.

In the present invention, each segment pattern is required to have a length of more than ½ of the wavelength of the subjective electromagnetic wave. The length is a length when each segment is linearly extended, even if it is bent or forms a circle. Accordingly, even if the segment is folded in bellows shape (FIG. 1 (*d*)), the length of the segment when stretched is required to have a length of more than ½ of the wavelength of the electromagnetic wave.

As explained above, the pattern which is not included in the definition of the above one-dimensional conductive segment pattern (1) of the present invention can be a segment pattern having a length of less than ½ of the wavelength of the subjective electromagnetic wave, for example series of dots, tiny black circles or series of short lines. Some examples of the zero-dimensional pattern are shown in FIG. 2.

The one-dimensional conductive segment pattern (1) to be used in the present invention may be formed by directly printing on an insulating intermediate material (3) with conductive ink. However, for the purpose of the present invention wherein a hard intermediate material, such as window glass, is used with high frequency, preferably there may be adopted a method of forming a one-dimensional conductive segment pattern (1) on a plastic film which can be of a roll form convenient for manufacture and transportation, and applying the pattern onto the intermediate material with an adhesive or tackifier. By using the above mentioned method, the conductive segment pattern (1) can be continuously printed with a printing roll, so that the production speed is remarkably improved.

The one-dimensional conductive segment pattern (1) may be formed in such manner that the pattern is drawn on a plastic film with water-based ink by printing or other method, and a conductive metal is applied thereon by deposition or sputtering to form a conductive metal thin film, followed by removing the water-based ink by washing with water to form a pattern.

A preferable method of forming the one-dimensional conductive segment pattern (1) comprises firstly forming a conductive metal thin film layer on the whole surface of a plastic film and then processing the metal thin film by an appropriate method (e.g. photolithography) to form a pattern.

The method of forming a conductive metal foil layer on the plastic film may be the conventional well known method. Examples thereof include conductive metal foil laminating method, vapor deposition sputtering of metal, or electroless plating method. Preferred method is vapor deposition of metal (concretely, vacuum deposition) or sputtering method. Examples of the usable metals are aluminum, copper, stainless steel, chromium, nickel, and the like, but the invention is not limited to them.

The plastic film having a metal foil layer may be commercially available. For example, a polyethylene terephthalate film vacuum-deposited with aluminum (aluminum vapor deposited film) is commercially available at a low price and in a large quantity, so that it is most desirable to use it from an economic point of view.

As to the method of pattern forming a metal foil, a known method may be employed, of which a suitable one is a photolithography method.

In general, the photolithography method is such that a photosensitive etching resist is applied to the whole surface of a medium, on which a pattern mask is laid in contact, and the medium is exposed to light. Thereafter, by utilizing the difference of solubility between the exposed portion and the unexposed portion with a developer, a resist pattern is formed. Further, the metal other than the pattern part is dissolved with an etching liquid to form a metal pattern.

In the case of the photolithography of aluminum vapor deposited film of the present invention, when an alkali developing type resist is used, because the metal to be etched is soluble in the developer, metal etching is simultaneously made in the developing process, so that the pattern formation can be easily made. Further, as the vapor deposited film is extremely thin, the resist film can be of a thin film. Therefore, this is not only economical but also is effective in requiring less resist drying time and necessary exposure amount, leading to a possibility to make roll-to-roll high speed continuous production.

According to the study of the present inventor, it has been shown that the extremely thin conductive film not only serves to show such reduction of production cost but acts quite advantageously in the point of the electric wave absorbing capacity. It has also been found that the pattern constituted by thin lines having less than 100 μ shows a high electric wave absorbing capacity.

Electromagnetic wave shielding layer (2)

As explained above, the electromagnetic wave shielding layer (2) and the insulating intermediate material (3) can be transparent so as to make the final product transparent, i.e. visible light permeable. In order to make the explanation clear, the electromagnetic wave shielding layer (2) is divided into two parts, opaque embodiment and transparent embodiment.

(Opaque embodiment)

The opaque electromagnetic wave shielding layer (2) of the present invention may be a layer having electromagnetic wave shielding capacity. A metal thin layer is generally used. Various kinds of metal are usable, and the metal having conductivity such as iron, aluminum, copper, gold, silver can be listed. In consideration of the cost and the like, iron, aluminum and copper are preferred. In case of the aluminum, aluminum foil and aluminum vapor deposited film are suitable, and in case of the copper, copper foil and copper plated film are suitable. The opaque electromagnetic wave shielding layer (2) may be directly formed on the insulating intermediate material (3) by the method such as plating or vapor deposition. Alternatively, it may be so practiced that an opaque electromagnetic wave shielding layer (2) is formed on a separate material and the formed layer may be applied to the intermediate material (3) by means of adhesion and the like.

(Transparent embodiment)

The transparent electromagnetic wave shielding layer (2) is one which has both visible light permeability and electromagnetic wave shielding ability, including vapor deposited ITO film, which is known as transparent electrocoductive film, metal mesh, and the like. The transparent electromagnetic wave shielding layer (2) may also be the segment pattern as explained for the one-dimensional conductive segment pattern, which, however, has electrical connection between the segments. This segment pattern which has electrical connection can be specifically called herein "two-dimensional conductive segment pattern" in contrast with the one-dimensional conductive segment pattern, because each segment is connected with another segment though connecting points.

According to the study of the present inventor, the two-dimensional conductive segment pattern is very useful for electromagnetic wave filter, because the electromagnetic wave does not permeate the conductive pattern having a maximum space of less than 1/20 of the wavelength. The subjective electromagnetic wave to be prevented has a wavelength of about 0.5 to 300 cm, or 60 GHz to 100 MHz and therefore the conductive pattern having a space of less than 500 μ has sufficient shielding ability of the subjective electromagnetic wave. The visible light is one of electromagnetic wave and governs light permeability, but its wavelength is very short and less than 1 μ. The visible light easily goes through the two-dimensional conductive segment pattern which is, therefore, useful for the shield material.

The electromagnetic wave shielding glass having a metal net sandwiched between glass, which is used in the prior art, uses the above mentioned phenomenon. Similar transparent shielding materials having net-type or lattice-type metal pattern are disclosed in Japanese Kokai Publications 55-82499, 62-57297 and 2-241098 and Japanese Utility Model Kokai Publication 63-195800. However, these prior art shielding materials all employ only the two-dimensional conductive segment pattern and does not suggest the combination with the one-dimensional conductive segment pattern (1). The working examples of the above references do not show any data of the attenuation of reflected electromagnetic wave, but merely show data of the attenuation of permeated electromagnetic wave. According to the study of the present inventor, the net type pattern of metal does not show absorption of electromagnetic wave. If the net-type pattern is combined with the one-dimensional conductive segment material in a certain arrangement as in the present invention, the combined material shows electromagnetic wave absorbing ability. Preferred two-dimensional conductive segment pattern used in the present invention are schematically shown in FIG. 3 (*a*) to (*f*).

The two-dimensional conductive segment pattern may be formed by the same method as explained in the preparation of the one-dimensional conductive segment pattern (1) above. Preferred is a photolithography of a transparent plastic film having a metal thin film thereon.

The two-dimensional pattern (2) does not have any limitation in thickness, but is preferably within the range of 50 to 5,000 Å, more preferably within the range of 100 to 1,000 Å. The width of the two-dimensional pattern (2) also does not have any limitation as long as transparency is secured, but generally is not more than 100 μ, preferably from 1 to 50 μ, more preferably 1 to 30 μ. If the width is more than 100 μ, transparency is not secured sufficiently.

Insulating intermediate material (3)

The insulating intermediate material (3) of the present invention may be a material having insulating ability. Plastic sheet and a foamed product thereof can also be used. On one side of the intermediate material (3), the vapor deposition of metal is conducted or a metal foil or metallic deposition film is applied to form a shielding layer, and on the opposite side a conductive segment pattern film is laminated. As the intermediate material, there may be utilized plastic outer walls of electronic apparatus or boards to be used for general construction material which satisfy the material thickness conditions of the present invention. In order to make the electromagnetic wave absorbing shielding material of the present invention transparent or visible light permeable, the intermediate material is made transparent or visible light permeable. The transparent intermediate material (3) includes glass, transparent plastic film or air. In case of glass, the transparent material (3) may be window glass on which the other layers (1) and (2) can be applied thereon. In case where the intermediate material (3) is air, the final material of the present invention is made lightest in weight. Typical examples of the transparent plastic film are polyethylene terephthalate (PET) film, polyethylene film, polypropylene film and the like.

The thickness of the intermediate material is 0.1 mm–10 mm, preferably 0.6 mm–6 mm. In case of the deviation from this range, electromagnetic wave absorbing capacity is lowered.

The significance of the present invention is that it is possible to make the weight of the electromagnetic wave absorbing material drastically reduced in comparison with the ferrite base material, because the electromagnetic wave absorbing capacity is not dependent on the quality of the intermediate material but air or foamed material and inorganic or organic porous material can be used. For example, when an aluminum foil or deposited aluminum film is used as a shielding material and the one-dimensional conductive segment pattern film is applied through the plastic foamed sheet of the thickness of the present invention, a lightweight electric wave absorbing shielding material of no larger than 400 g/m$^2$ can be made. This material has a weight of actually 1/100 of the weight of ferrite sintered body (larger than 40 Kg/m$^2$) generally used to obviate TV ghost, and can sufficiently cover the way to lightweight which is an object of the present invention.

An electromagnetic wave shielding material presently existing can be easily changed to an electromagnetic wave absorbing shielding structure, by applying the electromagnetic wave absorbing shielding material of the present invention to the existing electromagnetic wave shielding materials such as shielding glass, metal reflecting plate, metal deposited shielding material, and metal plated shielding material. For example, an adhesive tape of the present invention made by providing an adhesive on both sides of the plastic foamed sheet of adequate thickness and applying a conductive pattern film of the present invention to one side, is useful for realizing the electromagnetic wave absorption quite simply, just by applying to the inside of metallic casing of electronic apparatus or to the surface of the shielding material of the building, as an electromagnetic wave absorbing adhesive sheet.

In the electromagnetic wave absorbing shielding material of the present invention, the one-dimensional conductive segment patterns may be constituted not only by a single layer but by a plurality of layers. In such a case, it is desirable to draw the patterns to constitute the respective layers so as not to overlap. For example, a multilayered pattern as in FIG. 5 made by laminating the patterns as in FIG. 4 so that the patterns do not overlap and disposing each pattern three-dimensionally, shows outstandingly higher electromagnetic wave absorbing capacity than the pattern made by simply disposing the designs on a plane.

The designs of the one-dimensional conductive segment pattern to be used in the present invention are not specially limited, but they may have a segment that can have resonance with the subjective electromagnetic wave. With respect to this point, there can be utilized the structure of a plane antenna about which many proposals have been available in the field of the antenna engineering with the object of efficiently converting the electric wave signal to the current signal by the metal segments. Especially, the design as in FIG. 4 which has so far been known as spiral antenna can have a long segment drawn in a small area, so that it is preferable for absorbing the electromagnetic wave of relatively long wavelength of 0.5–300 cm (60 GHz–0.1 GHz) which is the subject of the present invention.

Another feature of the electromagnetic wave absorbing shielding material of the present invention is that the frequency range of he electromagnetic wave to be absorbed can be controlled by the size of the designs constituting the one-dimensional conductive segment pattern. In other words, the large size design having a long segment has a property to absorb mainly the electromagnetic wave of long wavelength region (low frequency region), and the small size design having a short segment has a property to absorb mainly that of the short wavelength region (low frequency region), and by utilizing these properties selective use of the designs can be made according to the object. Further, by using the pattern having large and small sized designs in mixture, an electromagnetic wave absorbing material effective over the wide frequency range can be made.

Further, by forming a layer of high dielectric constant or high magnetic permeability on the upper layer of the one-dimensional conductive segment pattern (1) of the present invention, absorption in the long wavelength region which necessitates a large size design can be realized by a design of small size.

For absorbing electric waves of long wavelength for 1–3 m which is required to cope with the unnecessary electromagnetic waves of electronic apparatuses or to take steps against TV ghost of multi-storied buildings, and the like, there is required at least the design having the outer diameter of more than 10 cm. Especially, in case of a small size electronic apparatus in which the mounting space cannot be secured, it is possible to make the necessary design size miniature with the above means. The layer of high dielectric constant or high magnetic permeability used herein can be formed by coating/laminating a coating composition/film dispersed with ferrite, metal, metal oxide, etc. The layer of high dielectric constant or high magnetic permeability is known to shorten the wavelength of electromagnetic wave. Namely, there is the following relation between the wavelength $\lambda_0$ of electromagnetic wave in vacuum and the wavelength $\lambda$ of electromagnetic wave in a medium having the dielectric constant $\epsilon$ and magnetic permeability $\mu$ in vacuum.

$$\lambda = \lambda_0 \sqrt{\mu\epsilon}$$

Accordingly, these layers of high dielectric constant and high magnetic permeability are considered to be effective to shorten the electromagnetic wave reaching the pattern and to absorb even the small sized design.

EXAMPLES

Hereinafter, the present invention is concretely explained by examples. It should not be construed that the present invention is limited by these examples.

Example 1

On an aluminum deposited PET film made by Oike Kogyo (deposited film thickness 500 Å, PET thickness 100 μ) a positive type liquid resist made by Nippon Paint (Opt ER P-600) was coated to a dry film thickness of 0.5 μ, after which the film was dried in a hot air oven. On the film, a pattern mask of FIG. 6 was laid, which was exposed to light at 30 mJ/cm$^2$, after which the medium was developed with 1% aqueous solution of caustic soda (sodium hydroxide), and at the same time, the exposed deposited aluminum film part was etched to obtain an aluminum deposited pattern film. Next, The pattern film was applied on a 2 mm thick PP (polypropropylene) foam sheet from the opposite side of the patterned aluminum, and then an aluminum plate of 0.3 mm thick was applied to the foam sheed side to form an electromagnetic wave absorbing shielding material.

Example 2

Except that there was used a multilayered aluminum deposited pattern film made in such manner that in Example 1 a pattern mask of FIG. 4 was used instead of that of FIG. 6, and the resulting four aluminum deposited pattern films were laminated so that the designs do not overlap, the operation was made in the same manner as in Example 1 to give an electromagnetic wave absorbing shielding material.

Example 3

Except that in Example 2 there was used the pattern mask of FIG. 7 instead of that of FIG. 4, the operation was made in the same manner as in Example 2 to give an electromagnetic wave absorbing shielding material.

Example 4

An electromagnetic wave absorbing shielding material was formed as generally described in Example 1, with the exception that a copper deposited PET film having a deposited film thickness of 1,000 Å was employed instead of the aluminum deposited PET film and the etching was conducted with 2.5 % HCl/$FeCl_3$ at 41° C.

Example 5

An electromagnetic wave absorbing shielding material was formed as generally described in Example 2, with the exception that a 0.1 mm copper adhered plate having a copper thickness of 18 μ was employed instead of the aluminum deposited PET film and the resist was formed on the copper adhered plate in a thickness of 3 μ.

Example 6

According to Example 2 in which the PP foam sheet was used and a 0.3 mm thick ferrite film NP-D01 made by Nippon Paint (ferrite ethylene ester vinyl acetate copolymer resin dispersion) was applied to the surface of the electromagnetic wave absorbing shielding material on the side of the conductive pattern to give an electromagnetic wave absorbing shielding material.

Comparative Example 1

Except that in Example 1 there were used two pattern masks of FIG. 8 and FIG. 9 instead of that of FIG. 6, the operation was made in the same manner as in Example 1 to give a transparent electromagnetic wave absorbing shielding material.

Comparative Example 2

In place of the transparent electromagnetic wave absorbing shielding material of the present invention, there was used a material made by laminating a 1 mm thick aluminum plate on the 3 mm thick ferrite electromagnetic wave absorbing material NP-S01 made by Nippon Paint (ferrite particle ethylene-vinyl acetate copolymer resin dispersion).

With respect to the electromagnetic shielding materials obtained in Examples 1 to 6 and Comparative Example 1, the electromagnetic wave absorption and shielding performance were measured by the following measuring methods and the results thereof are shown in Table 1.

Further, in Example 2, the segment widths of the pattern mask were changed to 300, 100 and 30 μ and the electromagnetic wave absorptions in those cases are shown in Table 2.

Further, there is shown in FIG. 10 electromagnetic wave absorption in the case where in Example 2 the thickness of the intermediate material is changed.

Further, there is shown in FIG. 11 the relations between the measured frequency and the absorption in Examples 1, 2, 3 and 6.

<Method of measuring shielding performance>

To a pair of guide horn antenna installed in opposed manner, an network analyzer (HP-made 8510B) was connected and the S parameter (S21) of direct transmission wave between antennas was measured by 'free space time domain' method. With this set to a transmissive attenuation 0 dB, a sample for evaluating the shielding performance was set between the antennas and S21 was measured in the same manner to obtain transmissive attenuation (=shielding performance).

<Method of measuring electromagnetic wave absorption>

A guide horn antenna on the transmission side was installed so that the electromagnetic wave of parallel polarization was obliquely incident on the sample at 10° to the sample. On the receiving side, the same guide horn antenna was set up in he direction of optical reflection. With a network analyzer connected to the antenna, only the electromagnetic wave transmitted by reflecting on the sample was extracted by 'free space time domain' method to measure S parameter (S21). With S21 in the case of using the A1 plate as a sample set to be 0 dB, the samples of Examples and Comparative Examples were placed on the position of the A1 plate and S21 was measured to obtain reflective attenuation. The reflective attenuation in the sample having the transmissive attenuation of −40 dB was regarded as the electromagnetic wave absorption.

TABLE 1

| | Example | | | | | | Comparative Example | |
|---|---|---|---|---|---|---|---|---|
| | 1 | 2 | 3 | 4 | 5 | 6 | 1 (Common to two) | 2 |
| Shielding capacity (dB) | −40 | −40 | −40 | −40 | −40 | −40 | −40 | −40 |
| Absorbing capacity (dB) | −5 | −15 | −15 | −10 | −5 | −20 | 0 | −10 |
| Measured frequency (GHz) | 8 | 8 | 2 | 8 | 2 | 2 | 8 | 8 |
| Weight of absorbing material (20 × 20 cm, g) | 8 | 20 | 20 | 20 | 25 | 100 | 8 | 960 |

TABLE 2

| | | | |
|---|---|---|---|
| Segment width (μ) | 300 | 100 | 30 |
| Shielding capacity (dB) | −40 | −40 | −40 |
| Absorbing capacity (dB) | −10 | −12 | −15 |
| Measured frequency (GHz) | 8 | 8 | 8 |

It can be seen from Examples 1, 2 and Comparative Example 2 that the electric wave absorbing material of the present invention has realized reduction in weight to 1/50 −1/100 of conventional ferrite based absorbing material.

Further, according to Examples 3 and 4 it was possible to shift the absorbing region to a low frequency region by such means as 'size of design' and 'high dielectric constant, high magnetic permeability ferrite film lamination'.

Accordingly, by the present invention it has become possible to realize drastic lightweight and coordination with extensive frequency range.

Example 7

A positive type liquid resist (Opto ER P-600) was coated on an aluminum vapor-deposited PET film (aluminum thickness=500 Å, PET film thickness=100 μ; available from Oike Kogyo K.K.), and dried by a hot air oven in a dried coating thickness of 0.5 μ to form a resist layer. On the resist, a pattern mask as shown in FIG. 12 was placed and exposed at 30 mJ/cm$^2$, which was then developed with a 1% aqueous solution of caustic soda (sodium hydroxide) and simultaneous the aluminum layer was etched to obtain an aluminum deposited pattern film. Next, the film was applied to a glass surface of the 2 mm thick ITO deposited glass (aluminum thickness=2,000 Å, light permeability 85%) to form a transparent electromagnetic wave absorbing shielding material.

Example 8

A positive type liquid resist (Opto ER P-600) was coated on an aluminum vapor-deposited PET film (aluminum thickness=500 Å, PET film thickness=100 μ; available from Oike Kogyo K.K.), and dried by a hot air oven in a dried coating thickness of 0.5 μ to form a resist layer. On the resist, a pattern mask as shown in FIG. 13 was placed and exposed at 30 mJ/cm$^2$, which was then developed with a 1% aqueous solution of caustic soda (sodium hydroxide) and simultaneous the aluminum layer was etched to obtain an aluminum deposited pattern film having a pattern of FIG. 13.

Separately, an aluminum deposited pattern PET film having a pattern of FIG. 12 was formed as described in Example 7.

The two aluminum deposited pattern films were applied on the opposite side of a 2 mm thick glass plate to form a transparent electromagnetic wave absorbing shield material.

Example 9

An aluminum deposited pattern film having a pattern of FIG. 14 was obtained as generally explained in Example 7, with the exception that a pattern mask of FIG. 14 was employed.

An aluminum deposited pattern film having a pattern of FIG. 13 was obtained as generally explained in Example 8.

Four pieces of the pattern film with FIG. 14 pattern were laminated so as not to overlap one pattern with the other patterns to form a laminate. The laminate was applied on one side of a glass plate and the other aluminum deposited pattern film with FIG. 13 pattern was applied on the other side of the glass plate to form a transparent electromagnetic wave absorbing shielding material.

Example 10

An aluminum deposited pattern film having a pattern of FIG. 14 was obtained as generally explained in Example 7, with the exception that a pattern mask of FIG. 14 was employed.

An aluminum deposited pattern film having a pattern of FIG. 15 was obtained as generally explained in Example 7, with the exception that a pattern mask of FIG. 15 was employed.

An aluminum deposited pattern film having a pattern of FIG. 13 was obtained as generally explained in Example 8.

Four pieces of the pattern film with FIG. 14 pattern were laminated so as not to overlap one pattern with the other patterns to form a laminate. Separately, four pieces of the pattern film with FIG. 15 pattern were laminated so as not to overlap one pattern with the other patterns to form a laminate. The laminate with the pattern of FIG. 14 was applied on one side of a glass plate and the other aluminum deposited pattern film with FIG. 13 pattern was applied on the other side of the glass plate. On the side of the pattern of FIG. 13, another glass plate was applied and the opposite side was adhered to the laminate with the pattern of FIG. 15 to form a transparent electromagnetic wave absorbing shielding material.

Example 11

A transparent electromagnetic wave absorbing shielding material was formed as generally described in Example 9, with the exception that a copper deposited PET film having a deposited film thickness of 1,000 Å was employed instead of the aluminum deposited PET film and the etching was conducted with 2.5% $HCl/FeCl_3$ at 41° C.

Example 12

A transparent electromagnetic wave absorbing shielding material was formed as generally described in Example 9, with the exception that a 1 mm copper adhered plate having a copper thickness of 18 μ was employed instead of the aluminum deposited PET film and the resist was formed on the copper adhered plate in a thickness of 3 μ.

Comparative Example 3

A transparent material was prepared as generally described in Example 7, with the exception that a pattern mask of FIG. 16 was employed instead of the mask of FIG. 12 and a glass without ITO layer was employed.

Comparative Example 4

In place of the transparent electromagnetic wave absorbing shielding material of the present invention, there was used a material made by laminating a 1 mm thick aluminum plate on the 3 mm thick ferrite electromagnetic wave absorbing material NP-S01 made by Nippon Paint (ferrite particle ethylene-vinyl acetate copolymer resin dispersion).

With respect to the electromagnetic shielding materials obtained in Examples 7 to 12 and Comparative Example 4, the electromagnetic wave absorption and shielding performance were measured as mentioned above in by the following measuring methods and the results thereof are shown in Table 3.

Further, in Example 8, the segment widths of the pattern mask were changed to 300, 100 and 30 μ and the electromagnetic wave absorptions in those cases are shown in Table 4.

TABLE 3

| | Example | | | | | | Comparative Example | |
|---|---|---|---|---|---|---|---|---|
| | 7 | 8 | 9 | 10 FIG.14/ FIG.15 | 5 | 6 | 1 (Common to two) | 2 |
| Shielding capacity (dB) | −40 | −40 | −40 | −40/−40 | −40 | −40 | −40 | −40 |
| Absorbing capacity (dB) | −5 | −15 | −15 | −15/−15 | −10 | −5 | 0 | −10 |

TABLE 3-continued

| | Example | | | | | | Comparative Example | |
|---|---|---|---|---|---|---|---|---|
| | 7 | 8 | 9 | 10 FIG.14/ FIG.15 | 5 | 6 | 1 (Common to two) | 2 |
| Measured frequency (GHz) | 8 | 8 | 8 | 8/2 | 8 | 8 | 8 | 8 |
| Light permeability (%) | 50 | 58 | 42 | 28 | 42 | 0 | 60–70 | 0 |
| Weight of absorbing material (20 × 20 cm, g) | 8 | 8 | 20 | 36 | 20 | 25 | 8 | 960 |

TABLE 4

| | | | |
|---|---|---|---|
| Segment width (μ) | 300 | 100 | 30 |
| Shielding capacity (dB) | −40 | −40 | −40 |
| Absorbing capacity (dB) | −10 | −12 | −15 |
| Measured frequency (GHz) | 8 | 8 | 8 |
| Light permeability (%) | 4 | 13 | 42 |

As is clearly understood from Examples 7–9, the electromagnetic wave absorbing shielding material of the present invention show shielding ability and absorbing ability of electromagnetic wave, and light in weight and transparent. The electromagnetic wave absorbing ability is equal or more than that of ferrite.

As is understood from Example 4, the absorbing ability can exhibit in both direction and therefore show both the reduction of TV ghost outside a room and the leakage of undesired electromagnetic wave in the room.

Figure 1A:
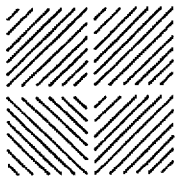
FIG. 1 is an example of the conductive patterns usable in the present invention.
Figure 1B:
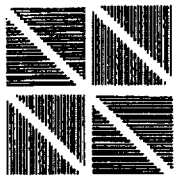
Figure 1C:
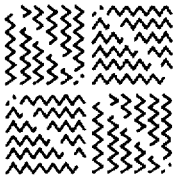
Figure 1D:
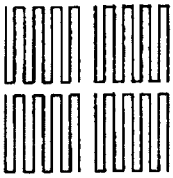
Figure 1E:
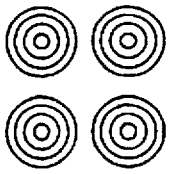
Figure 1F:
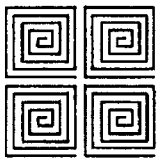
Figure 2A:
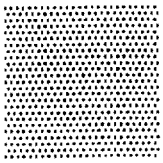
FIG. 2 shows examples of zero dimensional pattern which does not show absorbing ability of electromagnetic wave.
Figure 2B:
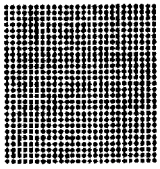
Figure 2C:
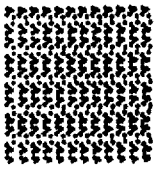
Figure 2D:
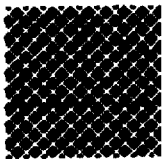
Figure 2E:
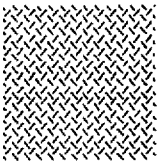
Figure 2F:
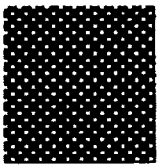
Figure 3A:
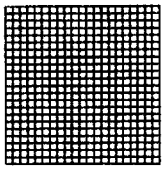
FIG. 3 shows examples of two-dimensional pattern.
Figure 3B:
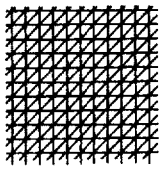
Figure 3C:
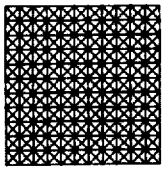
Figure 3D:
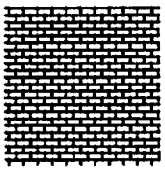
Figure 3E:
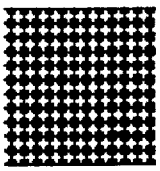
Figure 3F:
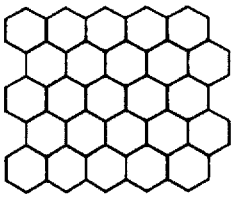
Figure 4:
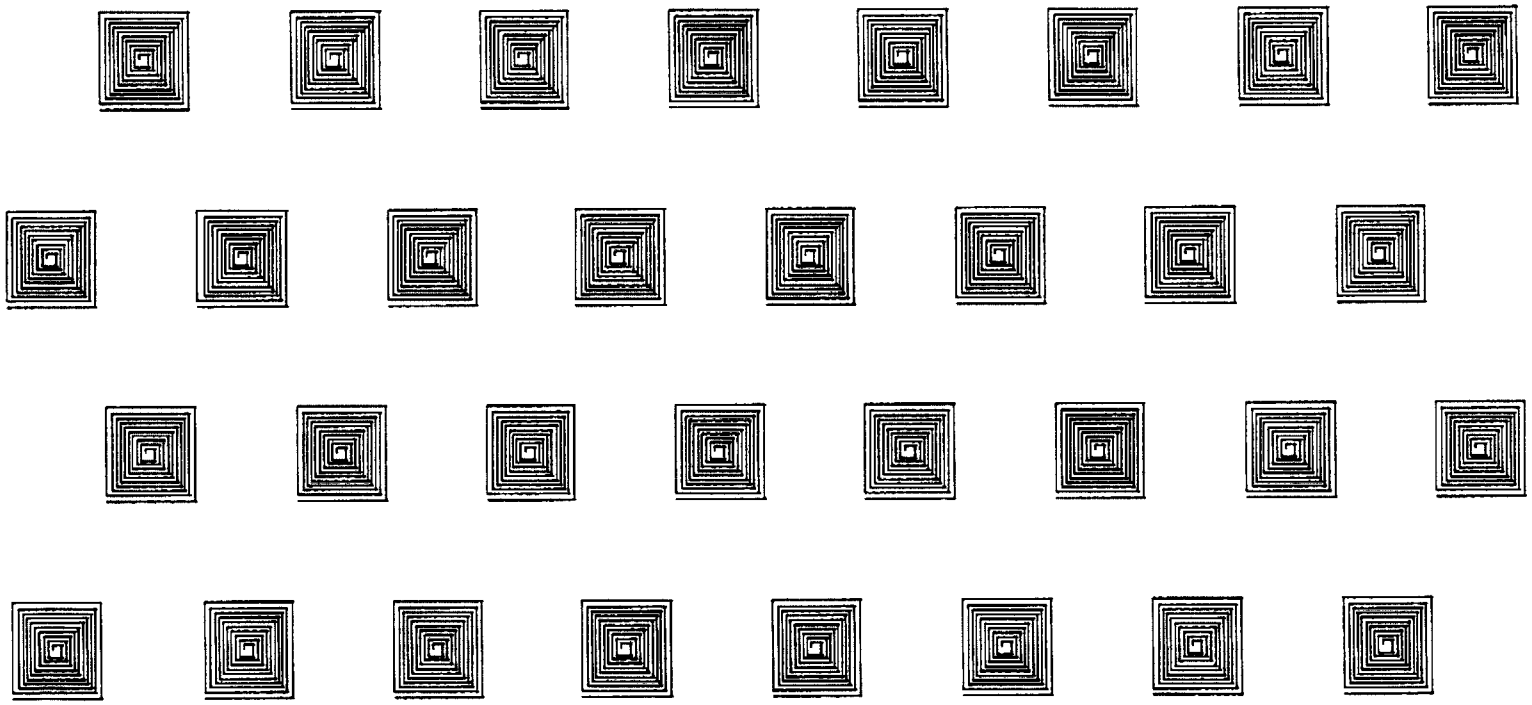
FIG. 4 is an example of the laminated patterns usable for enhancing absorbability.
Figure 5:
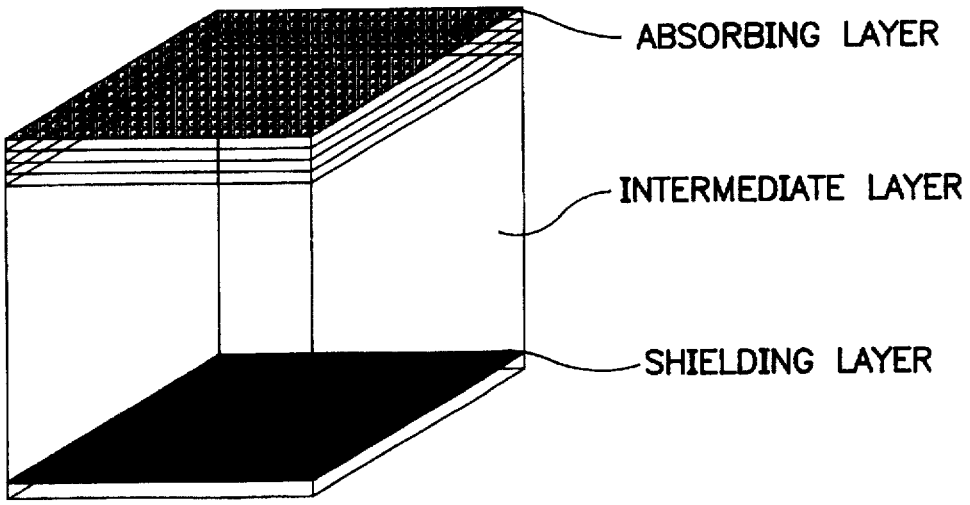
FIG. 5 is a cross-sectional view of he electric wave absorbing shielding material provided with a laminated pattern of FIG. 2 of the present invention.
Figure 6:
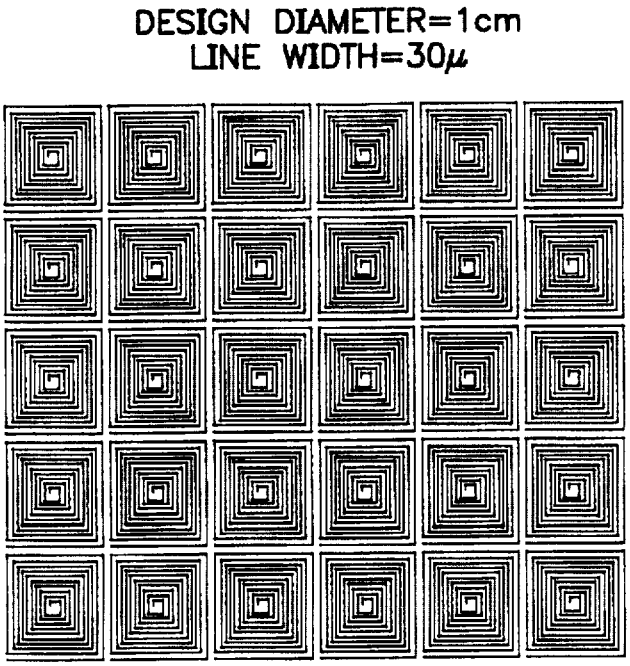
FIG. 6 is a one-dimensional conductive segment pattern used in Example 1.
Figure 7:
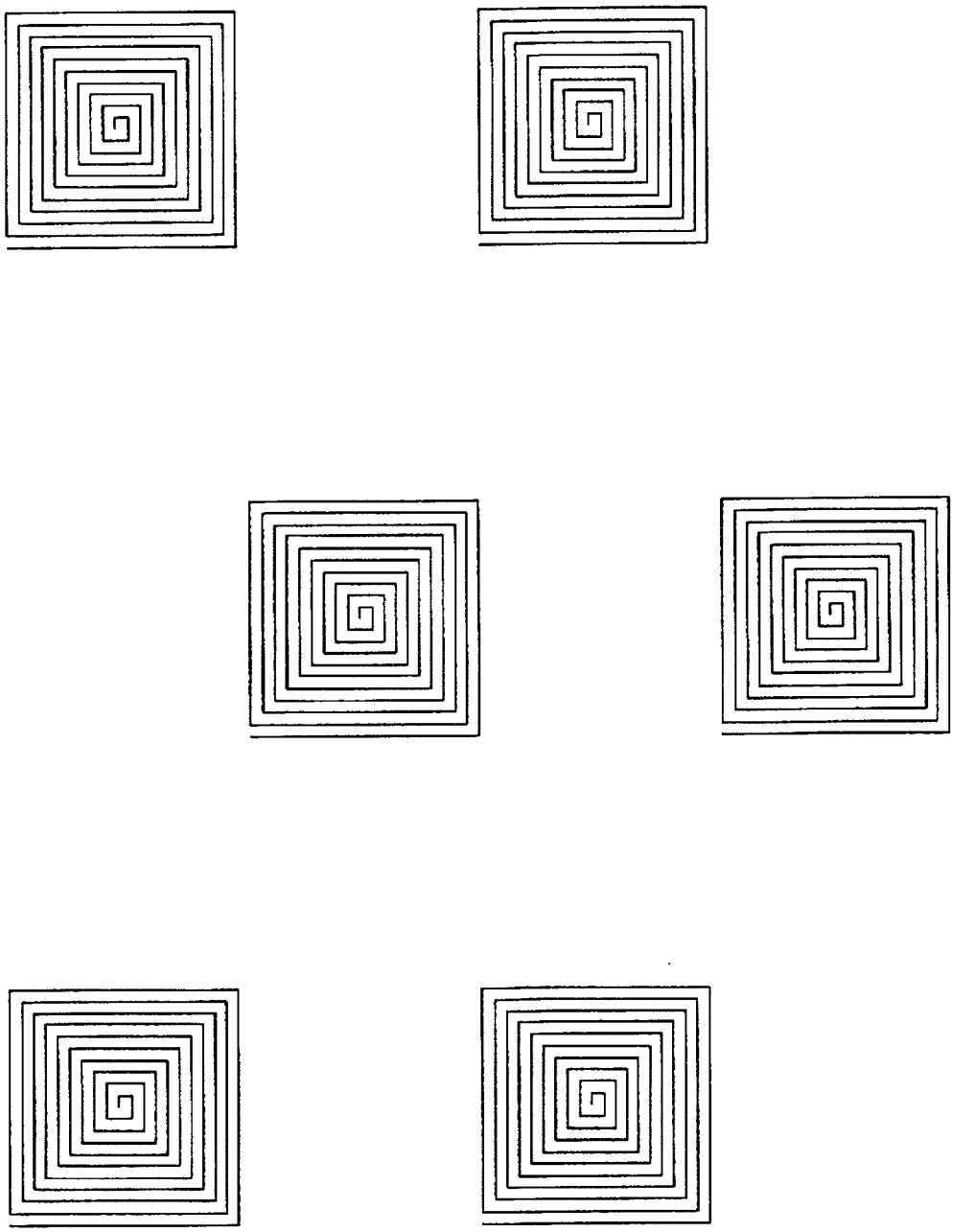
FIG. 7 is a one-dimensional conductive segment pattern used in Example 3.
Figure 8:
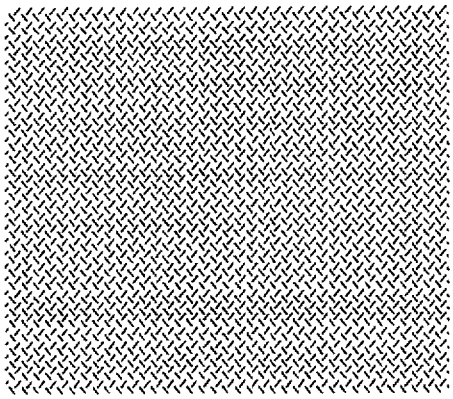
FIG. 8 is a one-dimensional conductive segment pattern used in Comparative Example 1.
Figure 9:
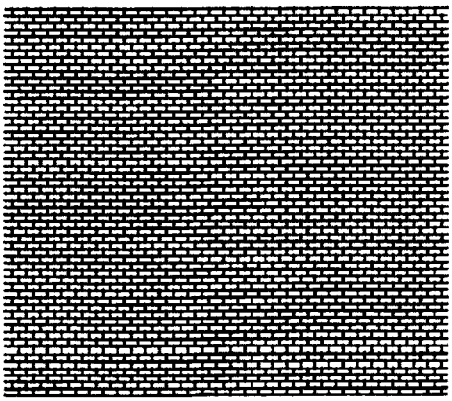
FIG. 9 is a pattern which showed no absorbing capacity in Comparative Example 1.
Figure 10:
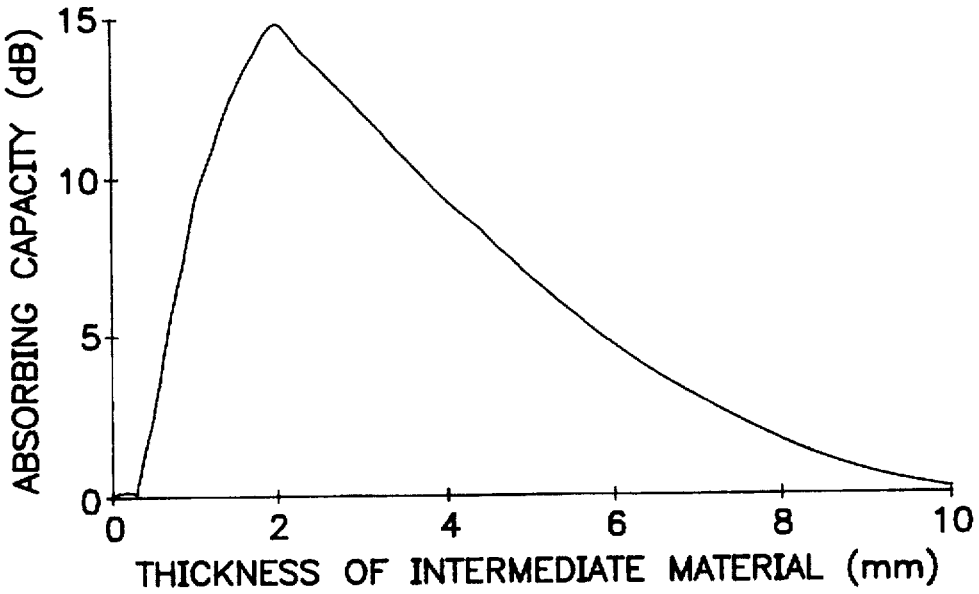
FIG. 10 is a view showing the relation between the thickness of the intermediate material and the absorbing capacity in Example 2.
Figure 11:
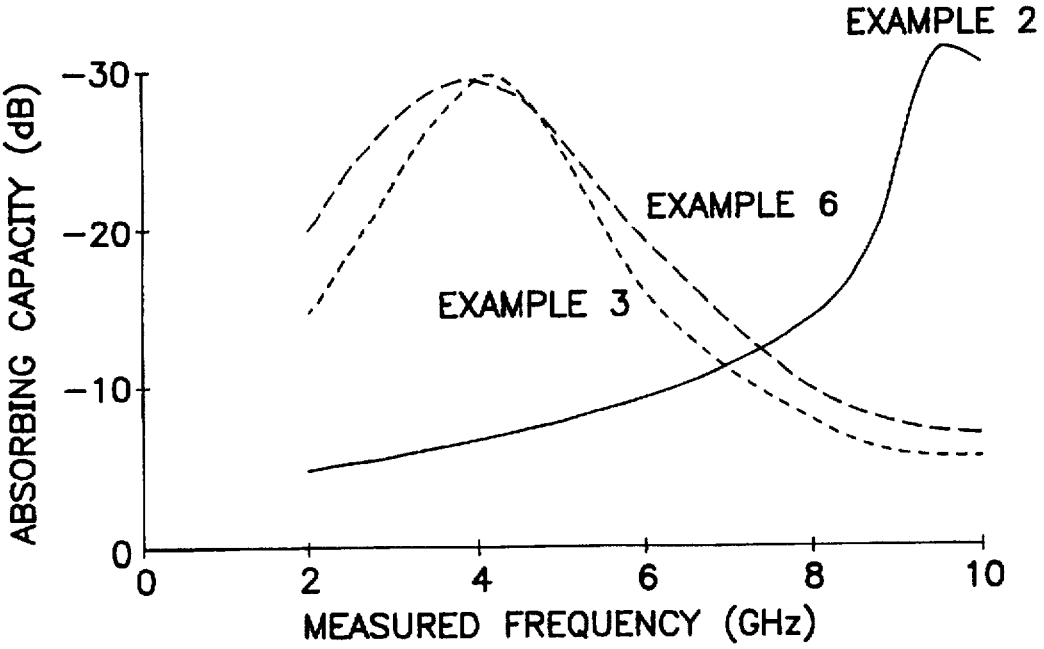
FIG. 11 is a view showing the relation between the absorbing capacity and the measured frequency indicating the shifting in the absorbing region in Examples 2, 3 and 6 of the present invention.
Figure 12:
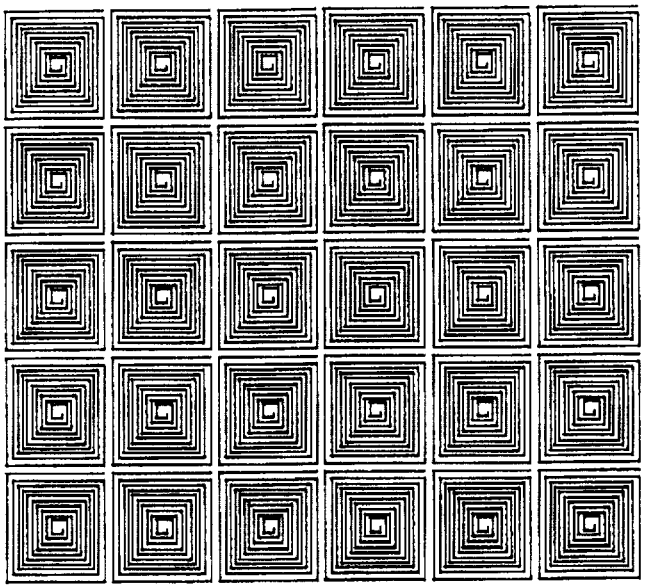
FIG. 12 shows a one-dimensional conductive segment pattern used in Example 7.
Figure 13:
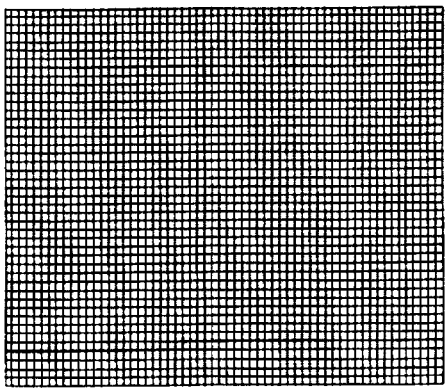
FIG. 13 shows a two-dimensional conductive segment pattern used in Example 8.
Figure 14:
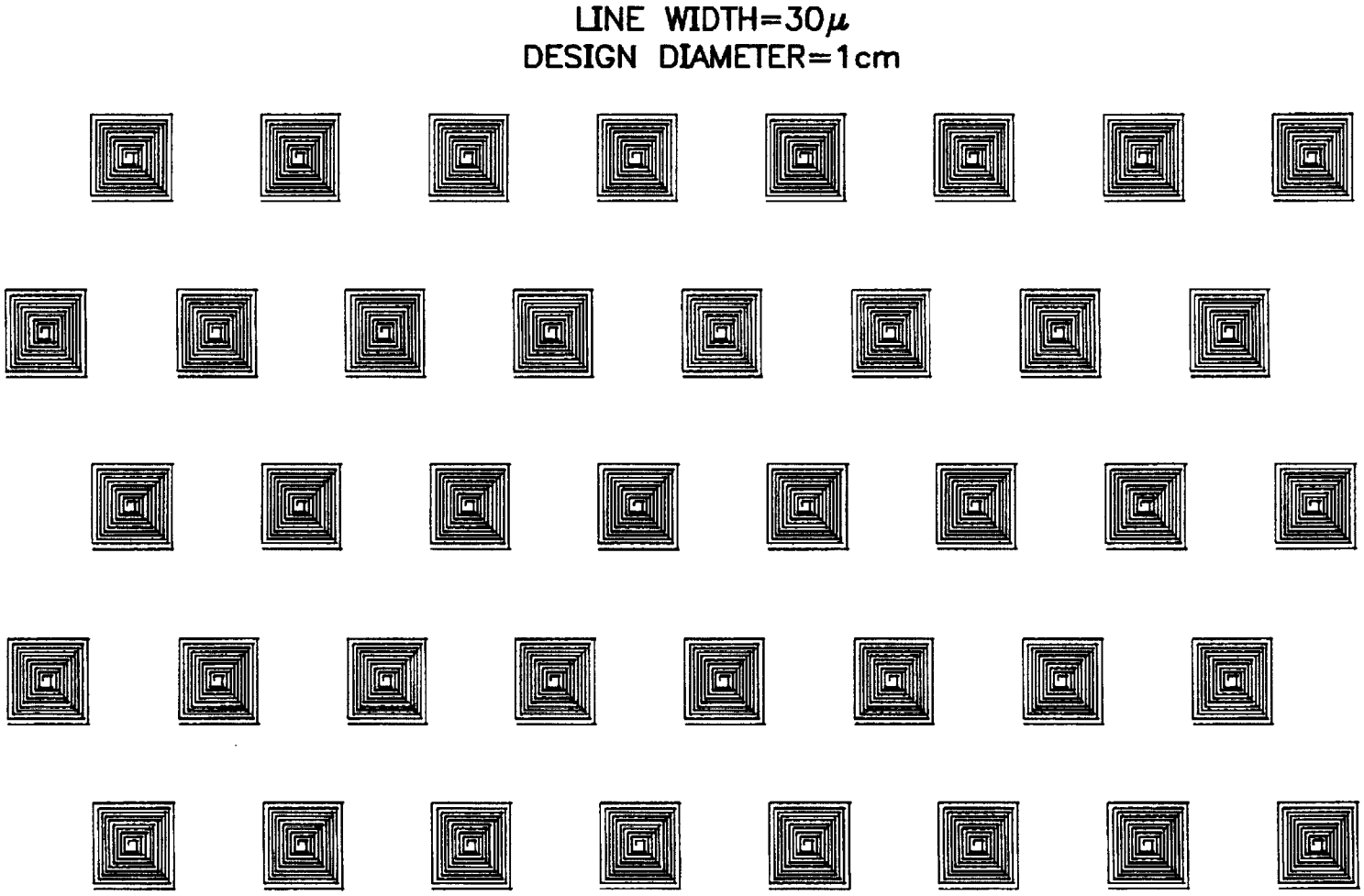
FIG. 14 shows a one-dimensional conductive segment pattern which show high electromagnetic wave absorption when laminated in Example 9.
Figure 15:
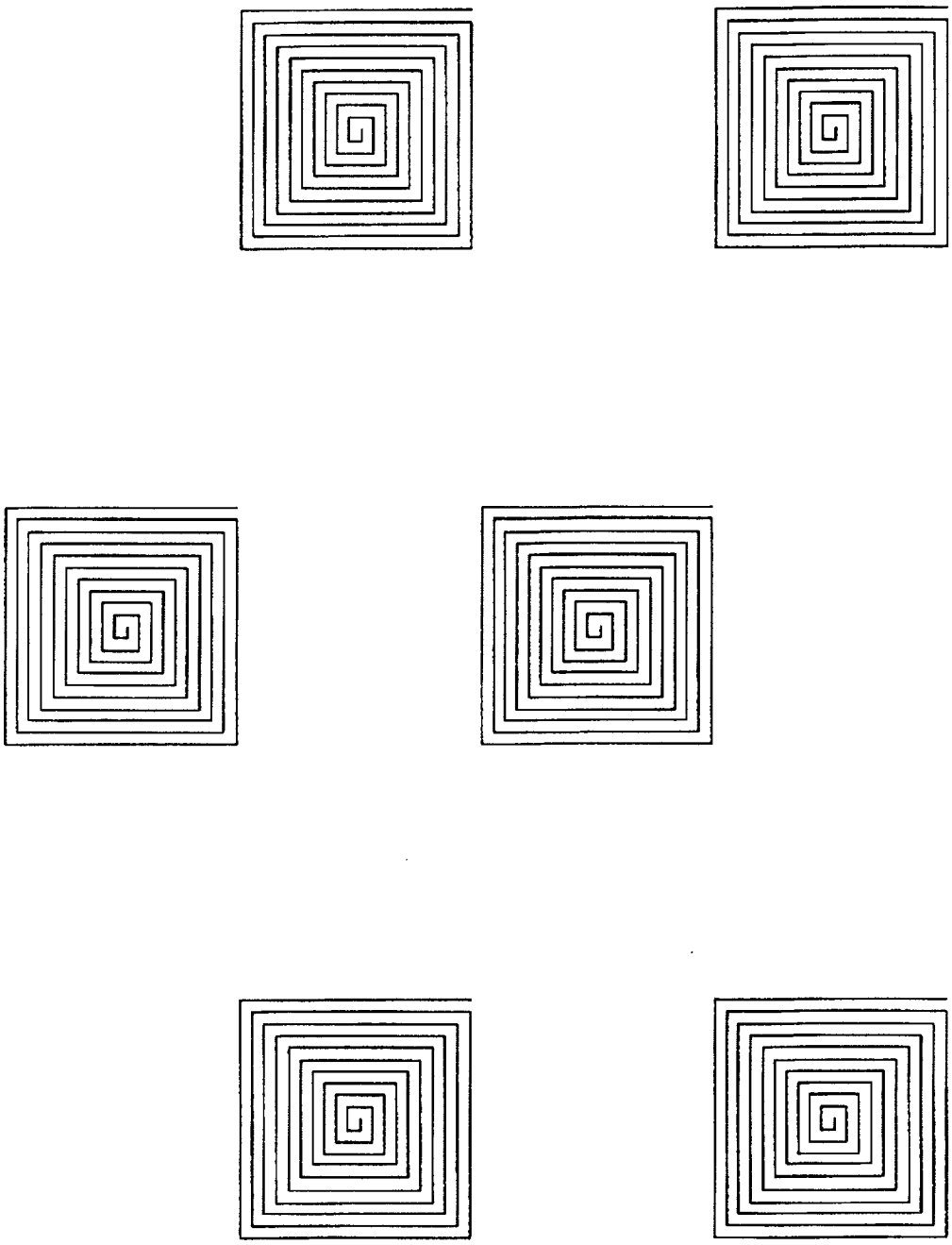
FIG. 15 shows a one-dimensional conductive segment pattern which shows high electromagnetic wave absorption when laminated in Example 10.
Figure 16A:
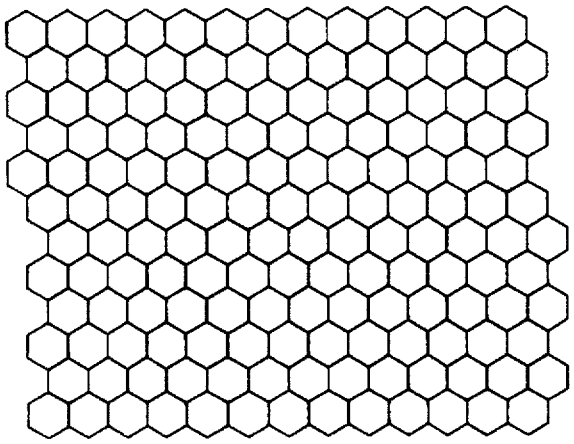
FIG. 16 shows a two-dimensional conductive segment pattern used in Comparative Example 3.
Figure 16B:
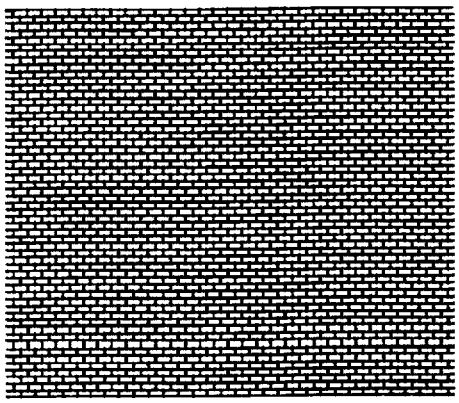
Figure 17:
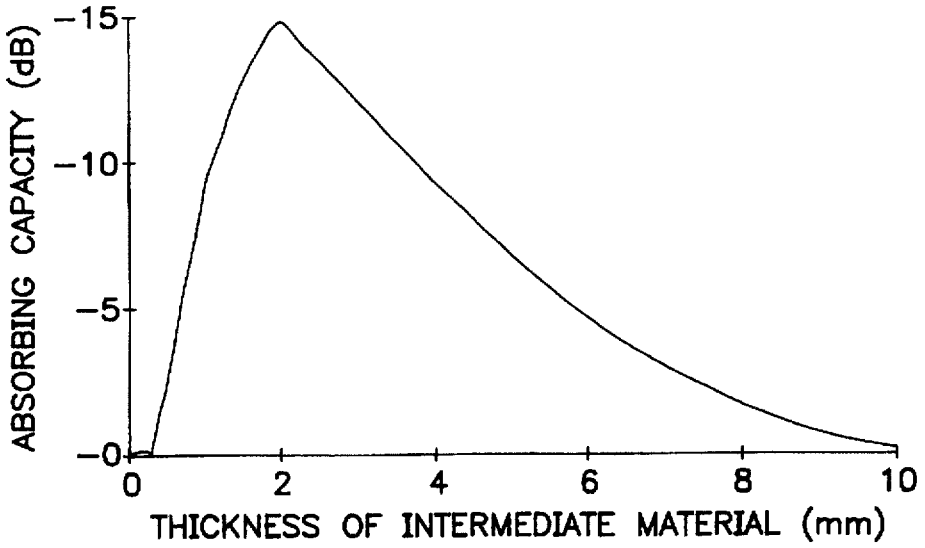
FIG. 17 is a graph showing a relation between thickness of the intermediate material and absorbing ability.
Figure 18:
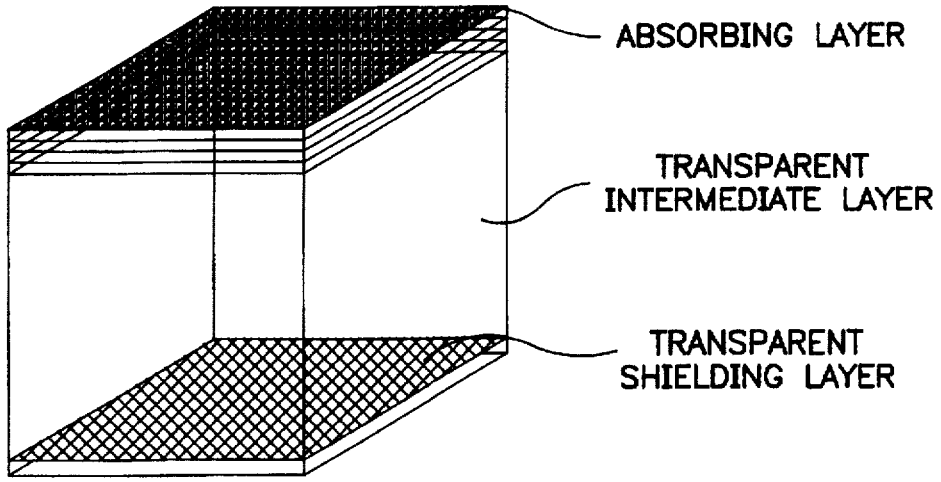
FIG. 18 is a perspective view of the 4 layers laminated electromagnetic absorbing shielding material of Example 9.

What is claimed is:

1. An electromagnetic wave absorbing shielding material comprising:

(1) a conductive segment pattern which is formed from conductive segments of a conductive material by patterning a deposited metal film having a thickness of 50 to 5,000 Å, said conductive segment pattern having a length of more than ½ of the wavelength of the subjective electromagnetic wave, and said conductive segments having no electrical connection therebetween, (2) an electromagnetic wave shielding layer, and (3) an insulating intermediate material having a thickness of 0.1–10.0 mm, located between the conductive segment pattern (1) and the electromagnetic wave shielding layer (2).

2. The electromagnetic wave absorbing shielding material according to claim 1, wherein the deposited metal film is a deposited aluminum film.

3. The electromagnetic wave absorbing shielding material according to claim 1, wherein the conductive segment pattern (1) is formed by photolithography from the deposited metal film, and each segment has a width of no more than 100 μ.

4. The electromagnetic wave absorbing shielding material according to claim 1, wherein the conductive segment pattern (1) is a single layer or a collective body of two or more layers.

5. The electromagnetic wave absorbing shielding material according to claim 1, wherein the electromagnetic wave shielding layer (2) is a metal thin film.

6. The electromagnetic wave absorbing shielding material according to claim 1, wherein the electromagnetic wave shielding layer (2) is two-dimensional conductive segment pattern which is net-like and has electric connection therebetween, and which has a maximum space of less than 1/10 of the wave length of the electromagnetic wave.

7. The electromagnetic wave absorbing shielding material according to claim 1, wherein the electromagnetic wave shielding layer (2) is a transparent electroconductive layer or a patterned one thereof.

8. The electromagnetic wave absorbing shielding material according to claim 1, wherein the insulating intermediate material (3) is opaque and formed from a plastic sheet or a foamed plastic material.

9. The electromagnetic wave absorbing shielding material according to claim 1, wherein the insulating intermediate material (3) is transparent and formed from glass, transparent plastic film or air.

10. The electromagnetic wave absorbing shielding material according to claim 1, further comprising a layer having high dielectric constant or high magnetic permeability, on the surface of the conductive segment pattern (1).

* * * * *